US005494457A

United States Patent [19]

Kunz

[11] Patent Number: 5,494,457

[45] Date of Patent: Feb. 27, 1996

[54] SNAGLESS STRAIN RELIEF

[75] Inventor: James B. Kunz, Blackstone, Mass.

[73] Assignee: ACS Industries, Inc., Woonsocket, R.I.

[21] Appl. No.: 314,198

[22] Filed: Sep. 28, 1994

[51] Int. Cl.[6] ..... H01R 13/50

[52] U.S. Cl. ..... 439/447; 439/344

[58] Field of Search ..... 439/352, 447, 439/901, 344, 676; 174/138 F, 135

[56] References Cited

U.S. PATENT DOCUMENTS 4,703,989 11/1987 Price et al. ..... 439/344

5,334,044 8/1994 Falossi et al. ..... 439/447

*Primary Examiner*—Gary F. Paumen

*Attorney, Agent, or Firm*—Salter & Michaelson

[57] ABSTRACT

A connector includes a cord and a plug attached to an end of the cord, the plug having a body portion and a resilient tab extending from the body portion at an angle with respect to the body portion. The tab has a free end and is movable towards the body portion when depressed. The tab further includes a first shoulder which releasably engages a second shoulder of a receptacle to releasably connect the plug to the receptacle. The plug is adapted to be disengaged from the receptacle upon depressing the tab. A boot is mountable on the cord in a position where it engages the plug for preventing snagging of the tab when pulling the cord backwards through a space having obstructions therein. The boot has a housing with an opening formed therein for receiving the body portion of the plug, and a pair of spaced apart, rigid wings each having upper edge margins which extend above and beyond the free end of the tab when the boot is assembled to the plug for protecting the tab from snagging by engaging the obstructions when pulling the cord backwards through the space so as to prevent the obstructions from engaging the tab. The tab is located between the wings such that the tab may be depressed without substantial interference from the wings. The boot also performs a strain relief function between the plug and the cord in a well-known manner.

8 Claims, 3 Drawing Sheets

SNAGLESS STRAIN RELIEF

BACKGROUND AND SUMMARY OF THE INVENTION

This invention relates generally to electrical connections, and more particularly to a boot for protecting the connection between a plug provided at an end of a cord and a receptacle.

In the art of electrical connections, such as communications cable and the like, it is well known to provide a cord having a plug attached to an end of the cord, the plug being receivable in a receptacle whereby electrical connections are established. In a typical embodiment, the plug has a body portion and a resilient tab extending from the body portion at an angle with respect thereto. The tab has interfitting connector portions which are engageable with mating interfitting connector portions of the receptacle in a latch-like relation for releasably securing the plug to the receptacle. The plug may be removed from the receptacle by depressing the tab, which is movable towards the body portion, for disengaging the interfitting connector portions of the tab from the interfitting connector portions of the receptacle. This is the type of interconnection typically used for connecting cord sets to telephones.

In many instances, when drawing or pulling a cord having such a plug through a narrow space (e.g., through walls or underneath flooring) having obstructions therein, such as other cords, electrical components, etc., the tab of the plug may snag or catch an obstruction which may result in the plug being disconnected from the receptacle or damage to the plug (e.g., breaking of the tab). One solution to the prevention of such damage to the tab of the plug has been to form the plug with wings which rise above the end of the tab, the wings engaging the obstructions and thereby protecting the tab. A disadvantage associated with this solution is that it does not lend itself to easily retrofitting existing cable systems since the plug must be replaced.

Another solution has been to provide a boot on the cord, the boot having a resilient bubble which overlies the tab for protecting it against snagging. This solution is disadvantageous in that it is difficult to depress the bubble and the tab located therebeneath to disconnect the plug from the receptacle, since the bubble, while fabricated from resilient material, is still somewhat rigid and stiff.

Accordingly, among the several objects of the present invention are the provision of an improved boot for protecting a tab of a plug which is easily applied to an existing connection; the provision of such a boot which, while protecting the tab, allows access to the tab for depressing the same to permit disconnection of the plug from a receptacle; the provision of such a boot which may be color coded for identifying various electrical cables and cords; and the provision of such a boot which is simple to design and easy to manufacture and assemble.

In general, a connector comprises a cord and a plug attached to an end of the cord, the plug having a body portion and a resilient tab extending from the body portion at an angle with respect thereto. The tab has a free end and is movable towards the body portion when depressed. The tab further includes a first shoulder which releasably engages a second shoulder of a receptacle to releasably connect the plug to the receptacle. The plug is adapted to be disengaged from the receptacle upon depressing the tab which disengages the first shoulder from the second shoulder. A boot is mounted on the cord to a position where it engages the plug for preventing snagging of the tab when pulling the cord backwards through a space having obstructions therein. The boot comprises a housing having an opening formed therein for receiving the body portion of the plug and a pair of spaced apart, rigid wings each having upper edge margins which extend above and beyond the free end of the tab when the boot is in its operative position for protecting the tab from snagging with the obstructions, since the wings prevent the obstructions from engaging the tab when the cord is snaked or pulled backwards through the space. The tab of the plug is located between the wings such that the tab may be depressed when desired without substantial interference from the wings. The boot also performs a strain relief function between the plug and the cord in a well-known manner.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

Corresponding reference numerals designate corresponding parts throughout the several views of the drawings.

DETAILED DESCRIPTION OF THE PREFERRED EMBODIMENT

Figure 1:
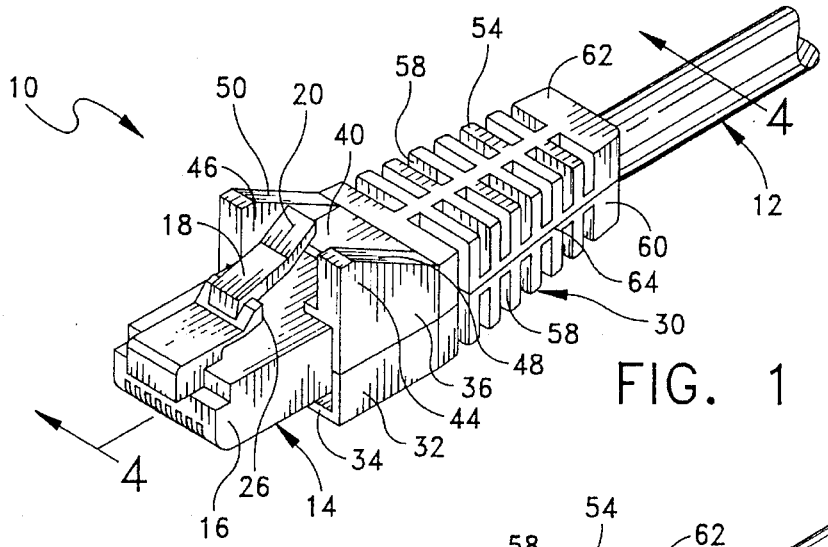
FIG. 1 is a front perspective view of a boot of the present invention in operative assembled relation with a plug and cord.
Figure 2:
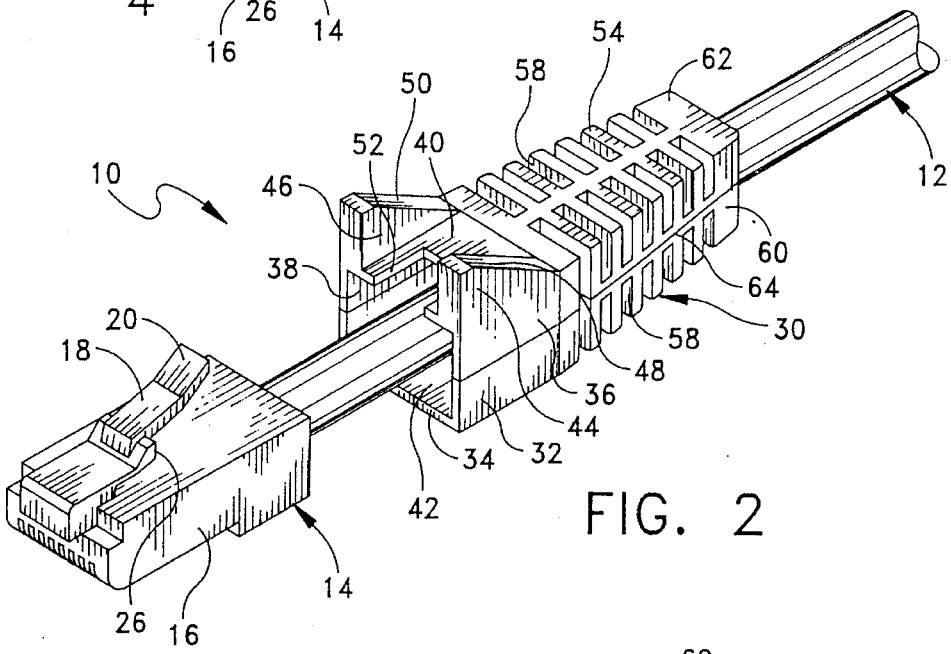
FIG. 2 is a front perspective view similar to FIG. 1 but illustrating the boot in a non-operative position spaced from the plug.
Figure 3:
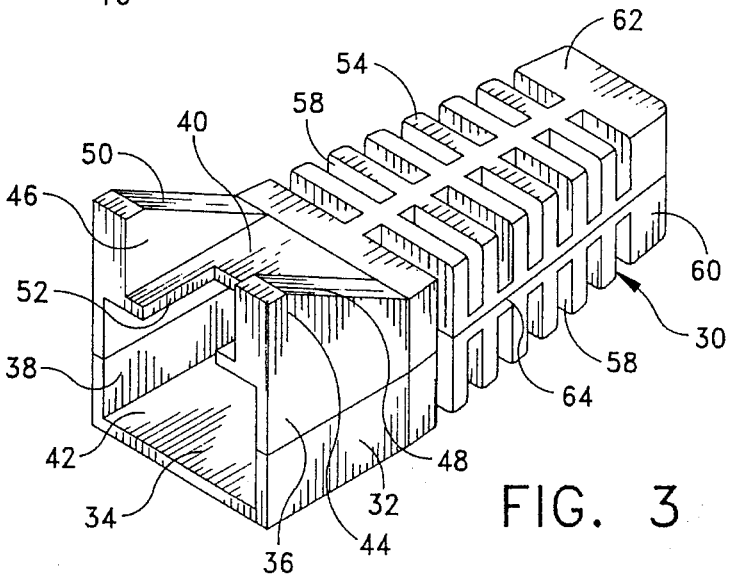
FIG. 3 is a front perspective view of the boot.
Figure 4:
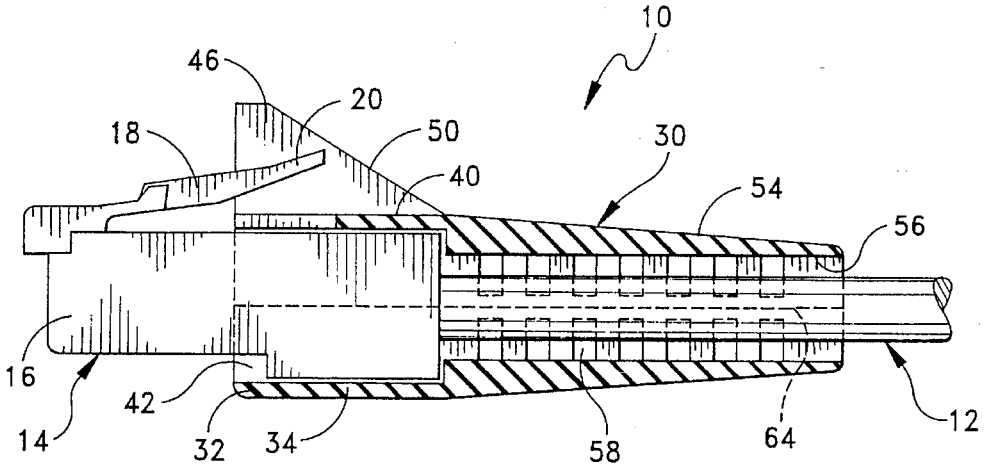
FIG. 4 is a cross-sectional view taken along line 4—4 of FIG. 1.
Figure 5:
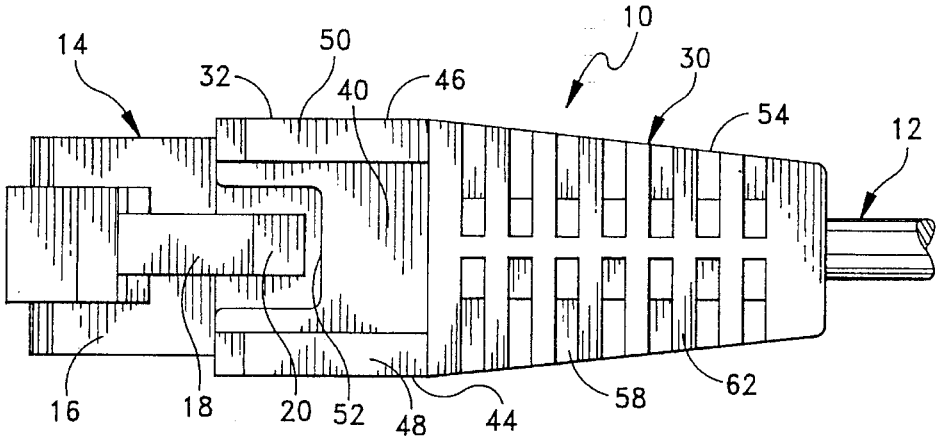
FIG. 5 is a top plan view of the boot and plug illustrated in FIG. 1.

Referring now to the drawings, and more particularly FIGS. 1 and 2, there is generally indicated at 10 an electrical connector comprising a cord generally indicated at 12, and a plug generally indicated at 14, attached to the end of the cord 12. The electrical connector 10 is of the type commonly used in communications cable and the like. The plug 14 has a generally rectangular-shaped body portion 16 and a resilient tab 18 extending angularly upwardly therefrom, as illustrated in the drawings. The tab 18 is integral with the body portion 16 and may be fabricated from any suitable rigid plastic material. The tab 18 has a free end 20 and is resiliently movable towards the body portion 16 when manually depressed.

Figure 6:
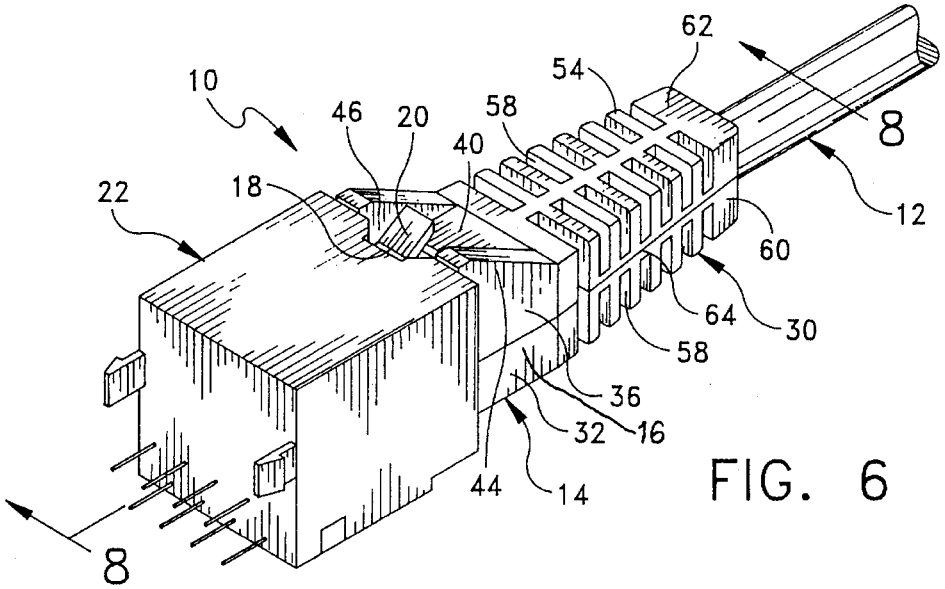
FIG. 6 is a front perspective view of the plug connected to a receptacle.
Figure 7:
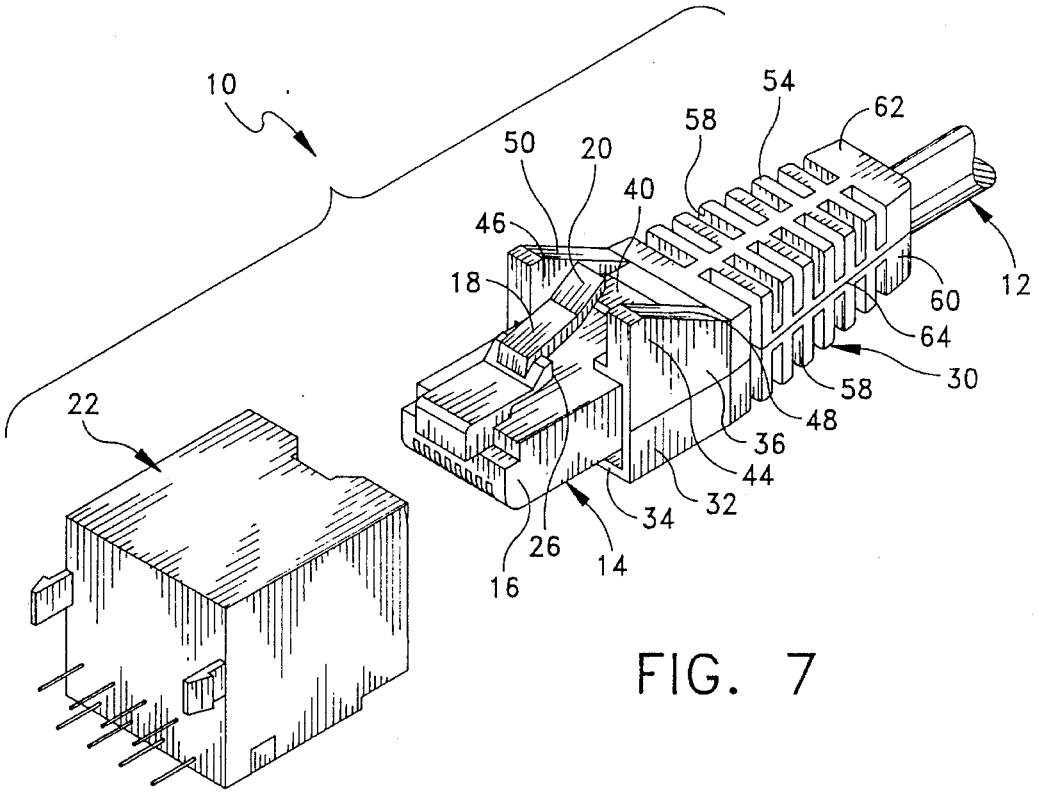
FIG. 7 is a front perspective view similar to FIG. 6 but with the plug disconnected from the receptacle.
Figure 8:
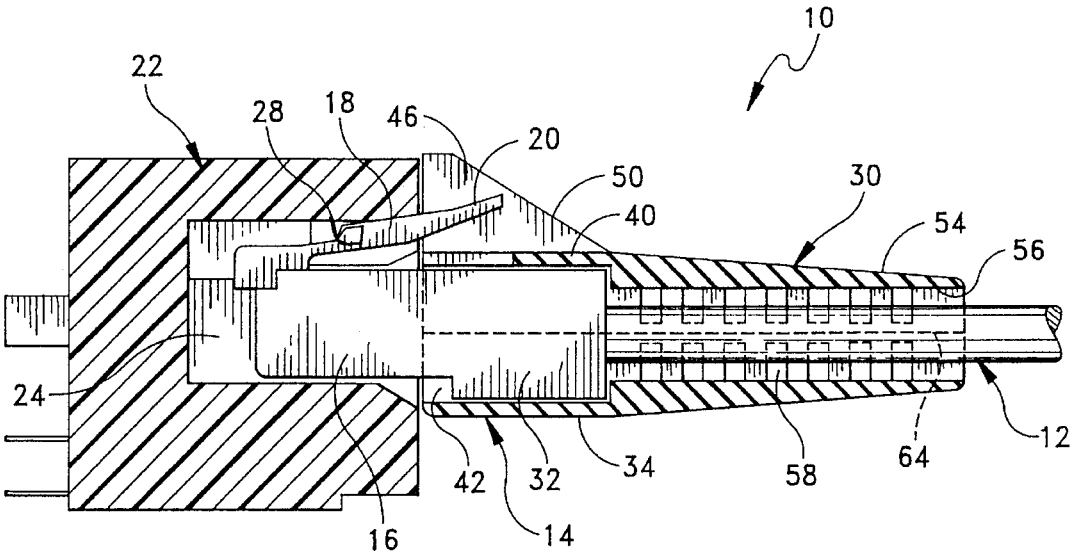
FIG. 8 is a cross-sectional view taken along line 8—8 of FIG. 6.

FIGS. 6–8 illustrate the plug 14 being connected to an electrical receptacle generally indicated at 22 having an opening 24 formed therein for receiving the plug 14. The tab 18 includes first interconnecting engaging means embodying a first shoulder 26 for releasably engaging second interconnecting engaging means of the receptacle embodying a second shoulder 28 (FIG. 8) to releasably connect the plug 14 to the receptacle 22. More particularly, the first shoulder 26, when the plug 14 is inserted into the opening 24 of the receptacle 22 as illustrated in FIG. 8, is spring biased upwardly due to the resilient nature of the tab 18 to engage the second shoulder 28. Upon depressing the tab 18 of the plug 14, the first and second shoulders 28 26, 28 disengage for permitting release of the plug 14 from the receptacle 22. This is the typical type of latch-like interconnection that exists in residential telephones.

It should be observed that when drawing or snaking the cord and plug assembly backwards through a narrow space (e.g., through walls or underneath flooring) having obstructions therein, such as other cords, electrical components, etc., the tab 18 of the plug 14 may snag or catch on such obstructions which may result in the plug 14 being disconnected from the receptacle 22, or damage to the plug (e.g., breaking of the tab).

In order to protect the plug 14, a boot, generally indicated at 30, is provided. As shown, the boot 30 is slidably movable over the cord 12 between an operative position where it engages the plug 14 (FIG. 1) and a non-operative position in which it is spaced away from the plug 14 (FIG. 2). The boot 30, preferably of molded plastic (e.g. polyvinylchloride), comprises a housing 32 having a bottom wall 34, two side walls 36, 38 and a top wall 40 which combine to define a generally rectangular-shaped opening 42 sized for receiving the body portion 16 of the plug 14. The housing 32 also includes a pair of spaced apart, rigid wings 44, 46 each having upper edge margins 48, 50, respectively, which extend above and beyond the free end 20 of the tab 18 when the boot 30 is assembled to the plug 14 as illustrated in FIG. 1. As illustrated, the wings 44, 46, although integral with the side walls 36, 38, are substantially thicker than the side walls 36, 38 so that they do not deform when forces (e.g., from engaging the obstructions) are applied thereto.

As mentioned above, the wings 44, 46 are sufficiently sized to extend above and beyond the free end 20 of the tab 18 so as to engage any obstructions when pulling or snaking the cord 12 through a space thereby protecting the tab 14 from unwanted contact with the obstructions. More particularly, the wings 44, 46 extend upwardly from opposite sides of the housing 32 at an angle intersecting the angle of the tab 18 of the plug 14. Thus, when the plug 14 and cord 12 are pulled backwards through a space, the angle of each wings 44, 46 is such that the wings do not catch or snag the obstruction, but slidably move past the obstruction.

When assembled to the plug 14 in a position such that the plug 14 is received in the opening 42 of the boot, the tab 18 of the plug 14 is located between the wings 44, 46 such that the tab 18 may be depressed without substantial interference from the wings 44, 46. To facilitate this, a slot 52 is formed in the top wall 40 of the boot housing 32 so that when depressing the tab 18, clearance is provided for permitting a maximum downward flexing of the tab.

The boot 30 further includes a strain relief section 54 integral with the housing for strengthening the connection of the cord 12 and the plug 14 and for absorbing any bending forces applied to that area. The strain relief section 54 is of conventional construction, having a bore 56 for receiving the cord 12 therein and a plurality of grooves or cut outs 58 formed on its exterior which extend generally perpendicularly to the length of the boot 30 and are located along the length of the strain relief section 54.

Preferably, the boot 30 is fabricated from any suitable plastic material so long as the wings 44, 46 maintain their rigidity when forces are applied thereto. Also, the housing 32 and strain relief section 54 of the boot 30 may be of two-piece construction having two sections 60, 62 releasably attachable to each other (as by adhesive, heat sealing, or the like) along respective edges 64 for directly attaching the boot 30 to the cord 12 without having to slip it over an end of the cord 12. Thus, the boot 30 may be applied over existing cord and plug assemblies by adhering the two separate sections 60, 62 together in a position such that the cable or cord is disposed within the bore 56 of the strain relief section 54 without having to remove the plug 14 from its end, and then sliding the boot along the cord until it reaches the assembled position shown in FIG. 1. Furthermore, the boot 30 may be color coded so as to identify the cord 12 from other cables and cords and to facilitate interconnection with the proper receptacle.

While there is shown and described herein certain specific structure embodying the invention, it will be manifest to those skilled in the art that various modifications and rearrangements of the part may be made without departing from the spirit and scope of the underlying inventive concept and that the same is not limited to the particular forms herein shown and described except insofar as indicated by the scope of the appended claims.

What is claimed is:

1. In a connector comprising a cord, a plug attached to an end of the cord, said plug having a body portion and a resilient tab angularly extending from the body portion, said tab having a free end and being movable towards the body portion when depressed, said tab having first interconnecting engaging means for releasably engaging second interconnecting engaging means of a receptacle to releasably connect the plug to the receptacle, said plug being adapted to be disengaged from the receptacle upon depressing said tab, the improvement comprising a boot mounted on the cord in a position where it cooperates with the plug to prevent snagging of the tab when pulling or snaking the cord backwards through a space having obstructions therein, said boot comprising a housing having an opening formed therein for receiving the body portion of the plug, and a pair of spaced apart, rigid wings each having upper edge margins which extend above and beyond the free end of the tab when the boot is assembled with the plug for protecting the tab from being snagged by said obstructions by preventing the latter from engaging said tab, said tab being located between the wings such that the tab may be depressed without substantial interference from the wings.

2. The boot as set forth in claim 1, said wings extending from opposite sides of the housing at an angle intersecting the angle of the tab whereby, when the cord and plug are pulled backwards through a space, the wings slidably move past any obstructions within the space.

3. The boot as set forth in claim 1 further comprising a strain relief section integral with the housing for strengthening the connection of the cord and the plug.

4. The boot as set forth in claim 1, said housing and wings of the boot being of molded plastic.

5. The boot as set forth in claim 1, said opening of the housing being rectangular and sized to receive the rectangular body portion of the plug therein, said housing further including a top wall spaced between the wings, said top wall having a slot formed therein so as to provide clearance for permitting maximum downward flexing of said tab.

6. The boot as set forth in claim 1, the housing being of two piece construction having two sections releasably attachable to each other along respective edges for permitting attachment of the boot to the cord without having to slip it over the end of the cord.

7. The boot as set forth in claim 1, the housing comprising a bottom wall, two side walls and a top wall which combine to define a generally rectangular-shaped opening sized for receiving the body portion of the plug.

8. The boot as set forth in claim 7, the wings extending upwardly from respective side walls and being integral therewith.

* * * * *